US009793036B2

(12) United States Patent
Gupta et al.

(10) Patent No.: US 9,793,036 B2
(45) Date of Patent: Oct. 17, 2017

(54) LOW TEMPERATURE SUPERCONDUCTOR AND ALIGNED HIGH TEMPERATURE SUPERCONDUCTOR MAGNETIC DIPOLE SYSTEM AND METHOD FOR PRODUCING HIGH MAGNETIC FIELDS

(71) Applicants: Particle Beam Lasers, Inc., Waxahachie, TX (US); Brookhaven Science Associates, LLC, Upton, NY (US)

(72) Inventors: Ramesh Gupta, Shoreham, NY (US); Ronald Scanlan, Ramona, CA (US); Arup K. Ghosh, Shoreham, NY (US); Robert J. Weggel, Reading, MA (US); Robert Palmer, Shoreham, NY (US); Michael D. Anerella, Jamaica Estates, NY (US); Jesse Schmalzle, Shoreham, NY (US)

(73) Assignees: Particle Beam Lasers, Inc., Waxahachie, TX (US); Brookhaven Science Associates, LLC, Upton, NY (US)

( * ) Notice: Subject to any disclaimer, the term of this patent is extended or adjusted under 35 U.S.C. 154(b) by 0 days.

(21) Appl. No.: 15/041,333

(22) Filed: Feb. 11, 2016

(65) Prior Publication Data

US 2016/0247615 A1 Aug. 25, 2016

Related U.S. Application Data

(60) Provisional application No. 62/116,159, filed on Feb. 13, 2015.

(51) Int. Cl.

| | |
|---|---|
| ***H01F 7/00*** | (2006.01) |
| ***H01F 6/06*** | (2006.01) |
| ***H01F 6/04*** | (2006.01) |

(52) U.S. Cl.
CPC *H01F 6/06* (2013.01); *H01F 6/04* (2013.01)

(58) Field of Classification Search
CPC ..... G03F 7/70025; G03F 7/20; G03F 3/046; G03F 3/038; G03F 3/0488; G03F 3/0346;
(Continued)

(56) References Cited

U.S. PATENT DOCUMENTS 3,731,241 A * 5/1973 Coupland ..... G21K 1/093 335/213
3,743,986 A * 7/1973 McInturff ..... H01B 12/10 174/125.1

(Continued)

*Primary Examiner* — Shawki S Ismail
*Assistant Examiner* — Lisa Homza
(74) *Attorney, Agent, or Firm* — Wilson Daniel Swayze, Jr.

(57) ABSTRACT

A dipole-magnet system and method for producing high-magnetic-fields, including an open-region located in a radially-central-region to allow particle-beam transport and other uses, low-temperature-superconducting-coils comprised of low-temperature-superconducting-wire located in radially-outward-regions to generate high magnetic-fields, high-temperature-superconducting-coils comprised of high-temperature-superconducting-tape located in radially-inward-regions to generate even higher magnetic-fields and to reduce erroneous fields, support-structures to support the coils against large Lorentz-forces, a liquid-helium-system to cool the coils, and electrical-contacts to allow electric-current into and out of the coils. The high-temperature-superconducting-tape may be comprised of bismuth-strontium-calcium-copper-oxide or rare-earth-metal, barium-copper-oxide (ReBCO) where the rare-earth-metal may be yttrium, samarium, neodymium, or gadolinium. Advantageously, alignment of the large-dimension of the rectangular-cross-section or curved-cross-section of the high-temperature-superconducting-tape with the high-magnetic-field minimizes unwanted erroneous magnetic fields. Alignment
(Continued)

may be accomplished by proper positioning, tilting the high-temperature-superconducting-coils, forming the high-temperature-superconducting-coils into a curved-cross-section, placing nonconducting wedge-shaped-material between windings, placing nonconducting curved-and-wedge-shaped-material between windings, or by a combination of these techniques.

18 Claims, 15 Drawing Sheets

(58) Field of Classification Search
CPC H01H 7/20; H01H 7/22; H01H 41/04; H01H 41/048; H01H 6/06
USPC ..... 335/216
See application file for complete search history.

(56) References Cited

U.S. PATENT DOCUMENTS 4,554,731 A * 11/1985 Borden ..... H01F 41/048 29/599
4,609,109 A * 9/1986 Good ..... B03C 1/0355 209/213
4,641,057 A * 2/1987 Blosser ..... H05H 7/20 313/62
4,769,623 A * 9/1988 Marsing ..... H01F 6/06 315/503
4,796,511 A * 1/1989 Eyssa ..... F41B 6/00 124/3
4,808,941 A * 2/1989 Marsing ..... H05H 13/04 315/503
5,065,497 A * 11/1991 Jarabak ..... H01F 6/00 29/564.7
5,072,516 A * 12/1991 Jarabak ..... H01F 6/00 29/599
5,098,276 A * 3/1992 Jarabak ..... H01F 6/00 29/599
5,160,911 A * 11/1992 Herring ..... H01F 6/00 335/216
5,232,650 A * 8/1993 Behan ..... H01F 6/00 264/219
5,289,150 A * 2/1994 Rabinowitz ..... H01F 6/008 310/52
5,525,583 A * 6/1996 Aized ..... H01F 6/02 29/599
5,798,679 A * 8/1998 Pissanetzky ..... G01R 33/381 335/299
6,288,624 B1 * 9/2001 Savelainen ..... G01R 33/3806 335/216
6,410,923 B1 * 6/2002 Crewe ..... H01J 37/1416 250/396 ML
6,621,395 B1 * 9/2003 Bromberg ..... H01F 6/008 335/216
6,921,042 B1 * 7/2005 Goodzeit ..... H01F 7/202 242/430
7,319,329 B2 * 1/2008 Huang ..... H01F 6/04 324/319
7,626,477 B2 * 12/2009 Huang ..... G01R 33/3815 324/319
7,656,258 B1 * 2/2010 Antaya ..... H01F 6/00 313/62
8,614,612 B2 * 12/2013 Antaya ..... H05H 7/04 315/502
8,791,656 B1 * 7/2014 Zwart ..... H05H 7/04 315/500
2007/0262269 A1 * 11/2007 Trbojevic ..... A61N 5/10 250/492.3
2009/0083967 A1 * 4/2009 Meinke ..... G01R 33/34007 29/602.1
2009/0206974 A1 * 8/2009 Meinke ..... H01F 5/00 336/224
2009/0251257 A1 * 10/2009 Stelzer ..... G01R 33/3802 335/300
2009/0251269 A1 * 10/2009 Stelzer ..... G01R 33/3804 336/208
2009/0251270 A1 * 10/2009 Meinke ..... G01R 33/3804 336/208
2009/0251271 A1 * 10/2009 Stelzer ..... H01F 5/02 336/208
2009/0295168 A1 * 12/2009 Meinke ..... H02K 3/28 290/55
2009/0325809 A1 * 12/2009 Hong ..... H01F 41/048 505/433
2010/0259117 A1 * 10/2010 Goodzeit ..... H02K 55/00 310/52
2015/0318102 A1 * 11/2015 Meinke ..... H05H 7/04 335/216
2016/0237667 A1 * 8/2016 Francis ..... E03C 1/302
2016/0254731 A1 * 9/2016 Roos ..... H02K 11/215
2016/0299606 A1 * 10/2016 Go ..... G06F 3/046
2017/0003597 A1 * 1/2017 Patra ..... G03F 7/70025

* cited by examiner

LOW TEMPERATURE SUPERCONDUCTOR AND ALIGNED HIGH TEMPERATURE SUPERCONDUCTOR MAGNETIC DIPOLE SYSTEM AND METHOD FOR PRODUCING HIGH MAGNETIC FIELDS

STATEMENT REGARDING FEDERALLY SPONSORED RESEARCH OR DEVELOPMENT

The present application was made with government support under contract numbers DE-AC02-98CH 10886 and DE-SC0012704 awarded by the U.S. Department of Energy. This invention was made under a CRADA C-14-03 between Particle Beam Lasers, Inc. and Brookhaven National Laboratory operated for the United States Department of Energy. The United States government has certain rights in the invention(s).

CROSS REFERENCE TO RELATED APPLICATIONS

U.S. Patent Documents

U.S. Pat. No. 4,641,057 February 1987 Henry G. Blosser and Bruce F. Milton

U.S. Pat. No. 5,525,583 June 1996 Dawood Aized and Robert E. Schwall

U.S. Pat. No. 5,914,647 June 1999 Dawood Aized and Robert E. Schwall

U.S. Pat. No. 7,781,376 August 2010 Thomas Kodenkandath, et al.

U.S. Pat. No. 7,656,258 February 2010 Timothy A. Antaya, et al.

U.S. Pat. No. 8,614,612 December 2013 Timothy A. Antaya and Joel Henry Schultz

Other Documents

R. C. Gupta, "A Common Coil Design for High Field 2-in-1 Accelerator Magnets," Presented at the 1997 Particle Accelerator Conference in Vancouver, Canada (1997).

N. Amemiya, et al., "Temporal behaviour of multipole components of the magnetic field in a small dipole magnet wound with coated conductors," 2015 Supercond. Sci. Technol. 28 035003.

Y. Iwasa, "Case Studies in Superconducting Magnets," $2^{nd}$ Ed. (Springer, 2009).

C. P. Bean: "Magnetization of hard superconductors," Phys. Rev. Lett. 8, 250 (1962).

J. van Nugteren, et al., "Study of a 5 T Research Dipole Insert-Magnet using an Anisotropic ReBCO Roebel Cable," IEEE Transactions on Applied Superconductivity, 15 Oct. 2014.

R. Gupta, "HTS Open Midplane Dipole," 2008 Low Temperature Superconductor Workshop, Tallahassee, Fla., Nov. 11-13, 2008 (http://www.bnl.gov/magnets/Staff/Gupta/Talks/ltsw08/ltsw08-omd-gupta.pdf).

R. Gupta, et al., "Open Midplane Dipole Design for LHC IR Upgrade," International Conference on Magnet Technology (MT-18) at Morioka City, Japan (2003).

P5 Report: "Building for Discovery: Strategic Plan for U.S. Particle Physics in the Global Context", http://science.energy.gov/~/media/hep/hepap/pdf/May%202014/FINAL_P5_Report_053 014.pdf.

COMSOL program: http://www.comsol.com

CROSS-REFERENCE TO A RELATED APPLICATION

Applicant Claims Right of Priority from U.S. Provisional Patent Application No. 62/116,159 which has Filing Date: Feb. 13, 2015; Name of Applicant: Brookhaven Science Associates, LLC, Upton, N.Y.; and Title of Invention: Superconductor Magnetic Tape Material, the contents of which are incorporate herein in its entirety.

FIELD OF THE INVENTION

The present invention relates to dipole magnet devices, more particularly, to a method and system of achieving very high (in the range of 16-25 or 19-25 teslas) magnetic dipole fields with reduced distortion in the field uniformity that is caused by magnetization field errors in superconductor tape materials.

BACKGROUND

Uses of dipole magnet devices capable of achieving very high magnetic dipole fields may include the bending of particle beams in synchrotrons, NMR imaging for scientific and medical analysis, wind power generation and the bending of particle beams in devices used for ion therapy.

Synchrotrons are particle acceleration devices that have been conventionally used to study high energy physics phenomena. Beams of particles are accelerated and bent into two nearly circular paths and are then brought into collision. Head-on collisions of individual particles may create new particles of scientific interest via the equation $E=mc^2$. Contemporary devices are large, with circumferences of tens of kilometers. In order to achieve significantly higher beam energies, one must increase either the circumference of the synchrotron or the magnetic field of its dipole magnets.

In the first synchrotrons, normal-conducting wires were used in conjunction with magnetic materials to form the dipole magnets, and fields were typically in the vicinity of 2 teslas. A significant advance in making larger dipole magnetic fields is described by Blosser and Milton (U.S. Pat. No. 4,641,057, February 1987), which teaches the use of superconducting dipole magnet technology for synchrotrons. In order to achieve even higher fields, high-temperature-superconducting materials have proven valuable. Aized and Schwall (U.S. Pat. No. 5,525,583, June 1996 and U.S. Pat. No. 5,914,647, June 1999) teach how control of the geometry of high-temperature-superconducting-tape can lead to an increase in the carrying capacity and center magnetic field produced by a high-temperature-superconducting-coil. Kodenkandath, et al. (U.S. Pat. No. 7,781,376, August 2010) teach how use of two layers of high-temperature-superconducting material, each of which is selected for its performance at a particular magnetic field direction and which, together, result in enhanced performance for high-temperature-superconducting-coils. Superconducting coils have enabled higher magnetic fields than what was achievable using earlier magnet technology. Antaya et al. (U.S. Pat. No. 7,656,258, February 2010) teach how to obtain magnetic fields of at least 9.9 teslas using low-temperature-superconducting-coils, and Antaya et al. (U.S. Pat. No. 8,614,612 December 2013) teach how to obtain magnetic fields in excess of 14 teslas using high-temperature-superconducting-coils. Hence, conventional techniques in dipole magnet devices include the use of normal conductors, low temperature superconductors and high temperature superconductors. Conventional techniques also include liquid helium systems to cool the coils, support structures to support the coils against Lorentz forces present in the system, electrical contacts to allow electric current into and out of the coils, and an open region for particle beam transport and other uses. These conventional techniques are presently limited to fields less than or equal to about 15 teslas, and control of erroneous fields can be difficult.

One of the issues in moving beyond 15 teslas involves persistent-current magnetization. Persistent-current magnetization may produce an unwanted distortion of the magnetic field in superconducting tape. This magnetization is proportional to the width of the superconductor that is perpendicular to the magnetic field. In the case of a high temperature superconducting (HTS) tape, the HTS tape may have one wide dimension for its tape face such as for example, 2 mm to 12 mm, whereas the thickness may be less by approximately three orders of magnitude: 0.5 microns to 5 microns (0.0005 mm to 0.005 mm). Therefore, with these dimensions, the HTS tape has a large asymmetry. The dimensions of the HTS tape are different from superconductors that are made with round wires (such as niobium titanium, niobium tin and Bi2212) where such a large asymmetry does not exist.

Examples of superconductor tape materials include low temperature superconductors (LTS) and high temperature superconductors (HTS). LTS materials such as NbTi and $Nb_3Sn$ may be cooled to about 4 K to become superconducting. HTS materials may become superconducting above 77 K. HTS in the form of a tape geometry (such as Bi2223 and ReBCO) in magnets may be subject to distortion in field uniformity due to the large magnetization (due to persistent-currents).

Early commercially available HTS materials were bismuth-based ceramic oxides featuring Bi-2223 and are sometimes referred to as first-generation HTS. Second-generation HTS materials have been developed using rare earth barium copper oxide ceramics. The rare earth element may be one or more of yttrium, samarium, or gadolinium. These HTS materials are commercially available in the form of a thin flat tape and are also referred to as multi-layer coated conductors. HTS tape may be used in many applications and devices, for example, superconducting magnetic energy storage (SMES) devices, particle accelerators and medical applications.

The current carrying capacity of the HTS tape is highly anisotropic. The current density when the field is parallel with the tape wide face is several times the value when the field is perpendicular to the tape wide face. As a result of this observation, J. van Nugteren, et al. ("Study of a 5 T Research Dipole Insert-Magnet using an Anisotropic ReBCO Roebel Cable," IEEE Transactions on Applied Superconductivity, 15 Oct. 2014) teach that aligning the tape may reduce the amount of expensive tape. Another characteristic of the tape conductor geometry is that large magnetization currents are generated when the magnetic field is perpendicular to the wide face of the tape. Since the magnitude of the magnetization current is proportional to the dimension of the conductor that is perpendicular to the applied magnetic field, the magnetization current is highly anisotropic for a tape type conductor where the wide face dimension is 2-12 mm and the thickness is 0.02-0.04 mm. Conventional cosine theta magnet designs and common coil design may be expected to generate large field errors, because the wide dimension of the tape remains mostly perpendicular to the field and this orientation generates large persistent currents. The geometry of the conductor is a major factor to the development of these field errors. One method that may reduce the distortions is the use of a Roebel cable available commercially. With this approach, the tape is cut into a pattern that allows several tapes to be nested together. This reduces the effective magnetization from the original width of the tape, e.g. 12 mm, to the width of the pattern, e.g., 2 mm. However, this is achieved by cutting and discarding about 50% of the original superconductor tape, which is very expensive. Also, the reduction in distortion achieved is limited to the ratio of tape width to pattern width.

There is an interest in superconducting magnets made with tape geometry because of significant advances in High Temperature Superconductors (HTS). Bi2212 is primarily available in round wire form, but Bi2223 and ReBCO are commercially available in tape form. Because of the high strength and large production of ReBCO (and Bi2223), tape conductors have generated interest in accelerator and other applications.

Achieving dipole magnet fields in the range of 16-25 or 19-25 teslas at high quality has proven difficult using conventional techniques.

Accordingly, there is a need for an improved method and system for generating magnetic dipole fields that will overcome the field limit of conventional techniques by providing magnetic fields in the range of 16-25 or 19-25 teslas at high quality while overcoming the problem presented by persistent-current magnetization effects.

SUMMARY

The present disclosure, which addresses the above desires and provides various advantages, describes a method and system for producing a dipole-magnet with high dipole magnetic fields by aligning high temperature superconductor magnetic tape so as to minimize the unwanted persistent-current magnetization effects. The system includes an open-region located in a radially-central-region to allow particle beam transport and other uses, low-temperature-superconducting-coils comprised of low-temperature-superconducting-wire located in radially-outward-regions to generate high magnetic-fields, high-temperature-superconducting-coils comprised of high-temperature-superconducting-tape located in radially-inward-regions to generate even higher magnetic-fields and to reduce erroneous fields, support-structures to support the coils against large Lorentz-forces, a liquid-helium-system to cool the coils, and electrical-contacts to allow electric-current into and out of the coils. The high-temperature-superconducting-tape may be comprised of bismuth-strontium-calcium-copper-oxide or rare-earth-metal, barium-copper-oxide (ReBCO) where the rare-earth-metal may be one or more of yttrium, samarium, neodymium, or gadolinium.

Distinctly, the present methods and system employ alignment of the large-dimension of the rectangular-cross-section or curved-cross-section of the high-temperature-superconducting-tape with the high-magnetic-field in order to minimize unwanted erroneous magnetic fields. Alignment may be accomplished by proper positioning, tilting the high-temperature-superconducting-coils, forming the high-temperature-superconducting-coils into a curved-cross-section, placing nonconducting wedge-shaped-material between windings, placing nonconducting curved-and-wedge-shaped-material between windings, or by a combination of these techniques.

Other features and advantages of the present methods and system will become apparent from the following detailed description of the embodiments, taken in conjunction with the accompanying drawings, which illustrate by way of example the principles of the methods and system.

BRIEF DESCRIPTION OF THE DRAWINGS

The invention is explained in more detail below with reference to the accompanying drawings in which.

DETAILED DESCRIPTION

In the following detailed description of the embodiments, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

In the present disclosure, a high-magnetic-field dipole-magnet system and methods are described to achieve high-magnetic-fields in a dipole-magnet 16 which may be in the range of 16-25 or 19-25 teslas by using a combination of Low Temperature Superconductors (LTS) and High Temperature Superconductors (HTS). Superconducting magnets include a liquid-helium-system to cool superconducting materials to the temperatures needed to support a high current density in the high-magnetic-field, support-structures to support the superconductors against the large Lorentz-forces present in the system, electrical-contacts to bring electric-current into and out of the superconductors, and an open-region located in a radially-central-region to allow particle beam transport and other uses, and the present system will include these aspects as well.

Figure 1:
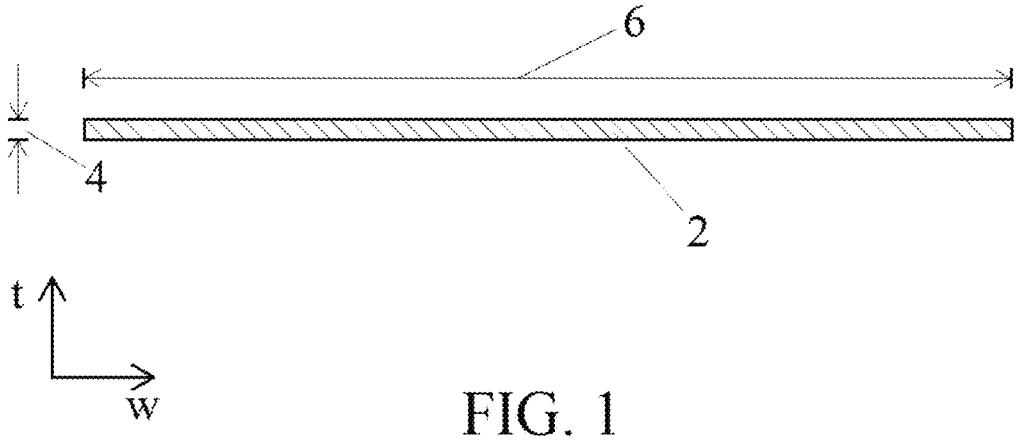
FIG. 1 is a schematic view of a high-temperature-superconductor-tape (HTS-tape) cross-section.
Figure 2:
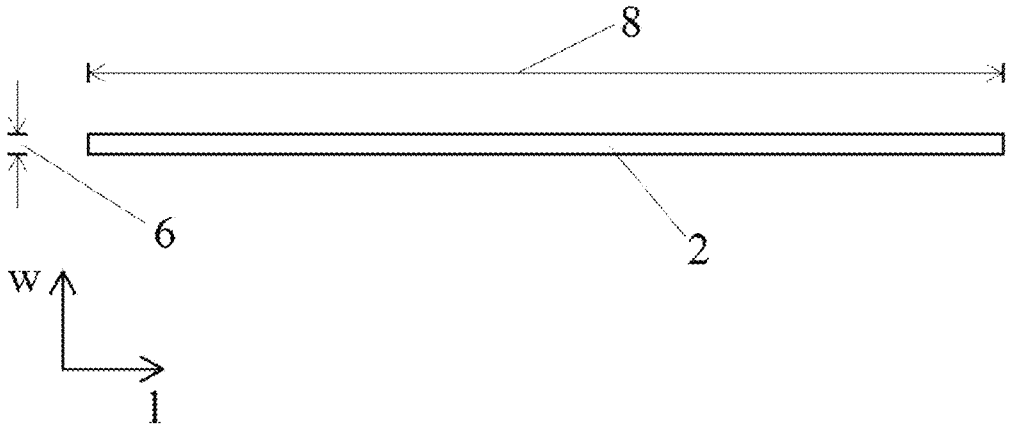
FIG. 2 is a schematic view of HTS-tape.
Figure 3:
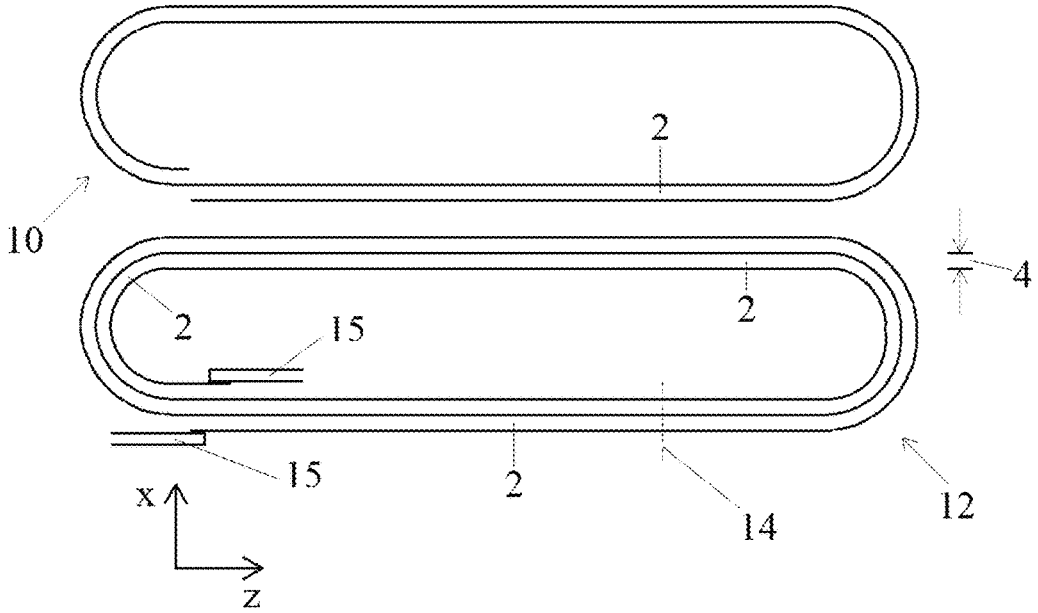
FIG. 3 is a schematic showing a single winding of HTS-tape as well as a schematic showing a HTS-coil.
Figure 4:
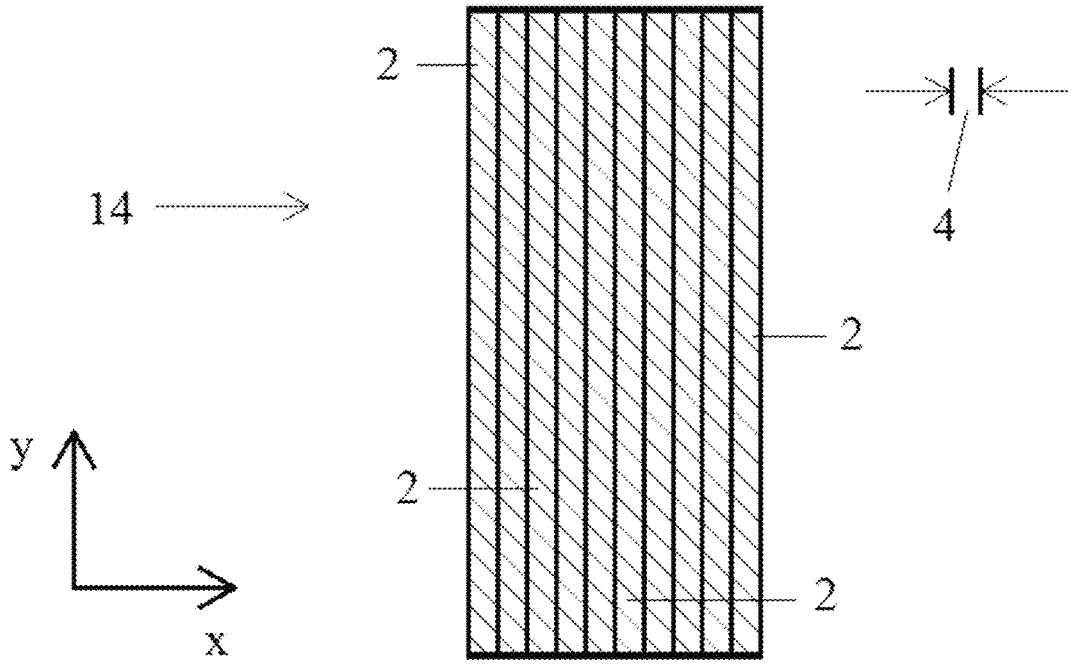
FIG. 4 is a schematic view of a flat and untilted HTS-coil cross-section.

HTS manufacturing techniques produce the HTS material in a tape form. Tapes are geometries that have a very small thickness, a larger width, and an even larger length. FIG. 1 shows a schematic of a high-temperature-superconducting-tape (HTS-tape) 2 having a relatively small HTS-tape-thickness 4 (typically around a few microns) and a relatively large-dimension HTS-tape-width 6 (typically 4 mm to 12 mm) forming a rectangular-cross-section. FIG. 2 shows a schematic of an HTS-tape 2 having a relatively small HTS-tape-width 6 (typically 4 mm to 12 mm) and a relatively larger HTS-tape-length 8 (lengths can vary significantly; they are typically longer than a few meters and may exceed 100 meters). The HTS-tape 2 may be comprised of bismuth-strontium-calcium-copper-oxide or rare-earth-metal, barium-copper-oxide (ReBCO) where the rare-earth-metal may be one or more of yttrium, samarium, neodymium, or gadolinium. FIG. 3 shows a schematic of the HTS-tape 2 wound into a winding 10, as well as multiple windings 10 wound to make a high-temperature-superconducting-coil (HTS-coil) 12. The term "block" is used to refer to a longitudinal section of an HTS-coil 12. FIG. 3 shows a perspective from the x-z plane, and also shows the position of a sample HTS-coil-cross-section 14. FIG. 4 shows a schematic of the HTS-coil-cross-section 14 from the perspective of the x-y plane.

Reducing Persistent-Current Effects.

In the present disclosure, a system and methods are described for a high-magnetic-field dipole-magnet 16 designed to have magnetic-field-lines 18 that may be substantially aligned with the HTS-tape-width 6 to reduce the persistent-current effects. (As is customary, this disclosure defines magnetic-field-lines 18 as lines that are aligned with the direction of the vector high-magnetic-field.) The present system design is based on the principle that persistent-currents may be determined primarily by the width of the conductor perpendicular to the magnetic-field-lines 18. The HTS-coil 12 designs may be made where the magnetic-field-lines 18 are oriented or aligned in such a way that they are substantially parallel to the HTS-tape-width 6 and substantially perpendicular to the HTS-tape-thickness 4. Since the conductor thickness within the HTS-tape 2 may be in the range of 0.5 microns to 3 microns, it is several orders of magnitude smaller than the HTS-tape-width 6, hence proper alignment may reduce the persistent-current effects by several orders of magnitude.

The present method may be used in a hybrid design for dipole-magnet 16, quadrupole or higher multi-pole magnets. It is a challenge to align the magnetic-field-lines 18 at all points in a magnet. However, in hybrid magnet designs, HTS-coils 12 are used in the higher field, radially-inward-regions where it is possible to align the magnetic-field-lines 18 within one degree to five degrees of the HTS-tape-width 6. Low-temperature-superconducting-coils (LTS-coils) (comprised of materials such as Nb3Sn and/or NbTi), which are composed of fine filaments of low-temperature-superconducting-wire, have much smaller magnetization than the HTS-tape 2 conductors and do not create similarly large field distortions. Hence, LTS-coils can be used in the lower field, radially-outward-regions. An example of a field plot is found in FIG. 5 for one quadrant and in FIG. 6 for a full cross section of a dipole-magnet 16. The figures show HTS-coil-cross-sections 14 used in high field regions, LTS-coil-cross-sections 20 used in relatively low field regions, as well as the magnetic-field-lines 18 calculated to result from simulated currents flowing in the HTS-coils 12 and LTS-coils.

Reducing Field Errors.

The magnet design may be developed where the HTS-coils 12 are oriented to align the HTS-tape-width 6 parallel to the magnetic-field-lines 18 to reduce the field errors caused by magnetization.

The present magnet design may reduce the magnetization-induced field distortions in magnets made with HTS-tape 2. The present design is based on the principle that field harmonics from induced persistent-currents may be determined primarily by the width of the conductor perpendicular to the magnetic-field-lines 18. The magnet designs are based on including as much as possible of the narrower side of the HTS-tape 2 and aligning it perpendicularly to the magnetic-field-lines 18 to reduce by an order to several orders of magnitude the field errors caused by persistent-currents. This design may increase the technical and economic viability of HTS-tape 2 use in future applications.

The magnitude of persistent-current magnetization that may cause unwanted distortion is related to the dimension of the tape that is perpendicular to the field. To reduce the persistent-current effects the HTS-coil 12 designs may be made where the magnetic-field-lines 18 are oriented or aligned in such a way that they are substantially parallel to the HTS-tape-width 6 and substantially perpendicular to the HTS-tape-thickness 4. Since the HTS-tape-thickness 4 is several orders of magnitude smaller than the HTS-tape-width 6, the persistent-current effects may be reduced by several orders of magnitude in comparison with a conventional magnet design.

Reducing Conductor Magnetization and its Degradation of Field Homogeneity; Increasing Efficiency.

The present method uses the alignment of the HTS-tape 2 with the magnetic-field-lines 18 to reduce conductor magnetization and its degradation of field homogeneity. This orientation or alignment also may contribute to increasing the efficiency of the HTS-tape 2 in the magnet.

The conductor magnetization effects in HTS magnets may be reduced by substantially aligning the HTS-tape-width 6 with the magnetic-field-lines 18. HTS-tape 2 conductors have one wide dimension with a width typically of 4 mm to 12 mm, with large width for higher current, and a thickness typically of 0.5 microns to 3 microns of superconductor. Thus, if the HTS-tape-width 6 is aligned substantially parallel to the magnetic-field-lines 18, the persistent-current effect may be reduced by orders of magnitude as compared to those in the conventional designs. With the present disclosure employing a substantially aligned tape design across the width, the effective filament size determining magnetization effects may be only 0.5 microns to 3 microns.

It has been found that in hybrid magnet designs where HTS-coils 12 are used in the higher field regions and conventional LTS-coils are used in the lower field regions, it is possible to align the HTS-tape-width 6 within 1 degree to 5 degrees of the magnetic-field-lines 18. LTS-coils (typically of $Nb_3Sn$ and/or NbTi strands with hundreds to millions of very fine filaments) have much smaller magnetization than HTS-tape 2 conductors and therefore may not create similarly large field distortions. This technique is illustrated for an open midplane dipole design in the first figure found in R. Gupta, "HTS Open Midplane Dipole," 2008 Low Temperature Superconductor Workshop, Tallahassee, Fla., Nov. 11-13, 2008 http://www.bnl.gov/magnets/Staff/Gupta/Talks/ltsw08/ltsw08-omd-gupta.pdf) incorporated herein by reference in its entirety.

Figure 5:
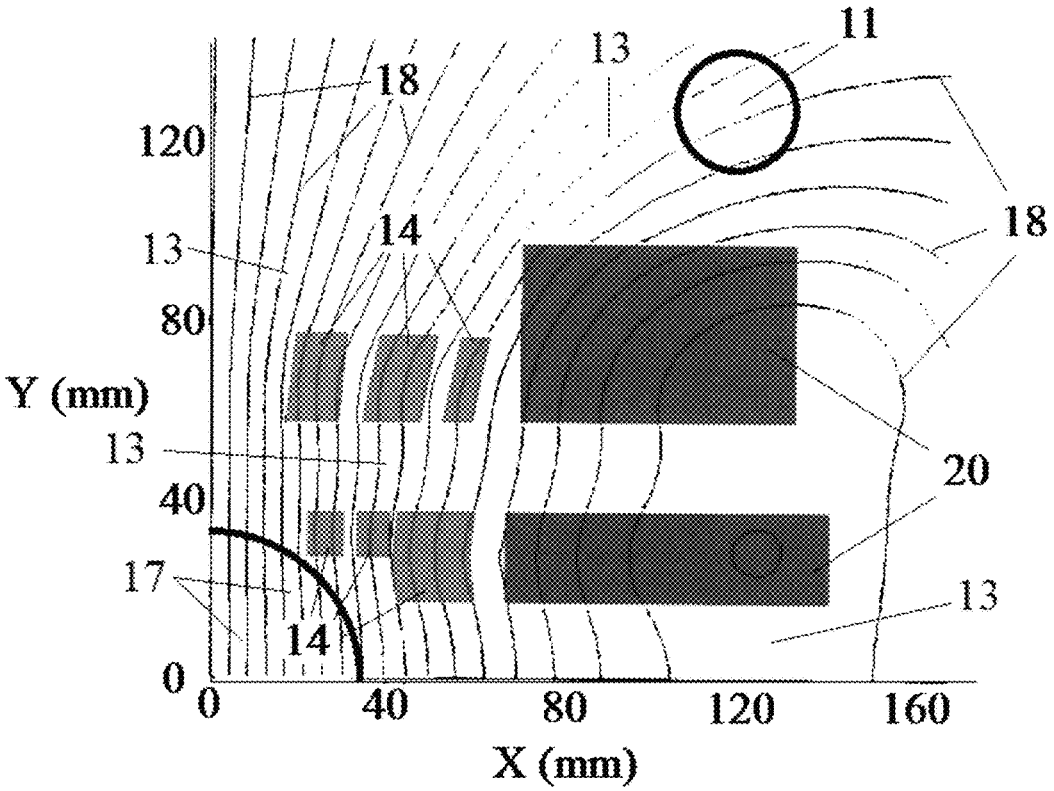
FIG. 5 is a calculation of the magnetic fields in a quadrant of a dipole-magnet cross-section comprised of HTS-coils and LTS-coils.

The HTS-coils 12 (FIG. 5 shows only those in quadrant #1) may be wound with the HTS-tape-width 6 substantially aligned parallel to the magnetic-field-lines 18. The design may use an HTS-tape-width 6 nominally 12 mm wide. Both HTS and LTS coils have a support structure between the upper and lower coil blocks as described in R. Gupta, et al., "Open Midplane Dipole Design for LHC IR Upgrade," International Conference on Magnet Technology (MT-18) at Morioka City, Japan (2003) incorporated herein by reference in its entirety.

An Embodiment—Tilting the Coils

Figure 7:
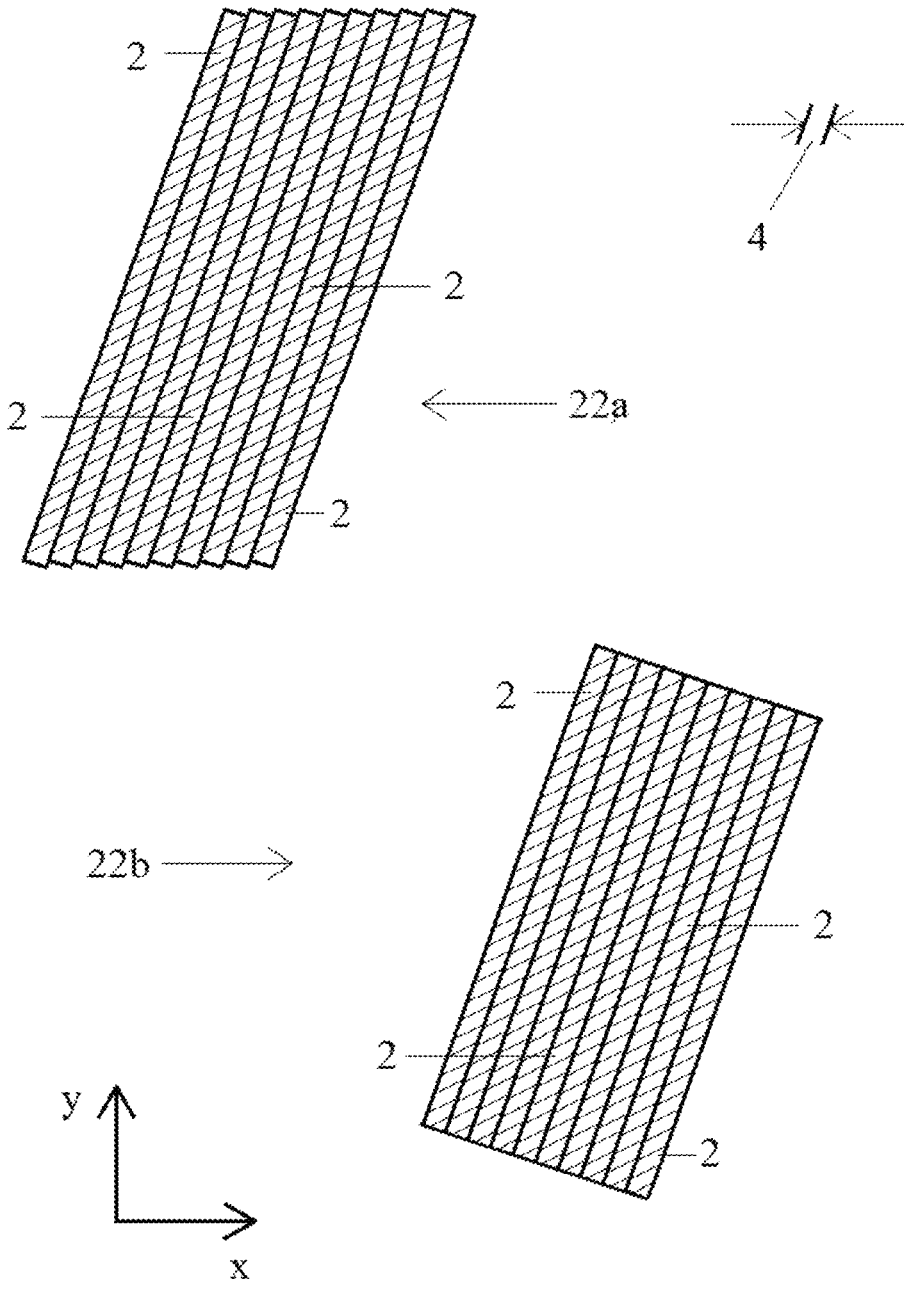
FIG. 7 is a schematic view of a flat and tilted HTS-coil cross-section.

An embodiment could involve tilting/angling the HTS-coils 12 to substantially align them with the magnetic-field-lines 18. FIG. 7 is a schematic of two tilted-HTS-coil-cross-section 22 examples. In one example, the HTS-coil 12 is fabricated with individually tilted/angled HTS-tape 2 to produce a tilted-HTS-coil-cross-section 22*a*. In a second example, the HTS-coil 12 is simply rotated to produce a tilted-HTS-coil-cross-section 22*b*.

The HTS-coils 12 may be tilted to align them substantially parallel to the magnetic-field-lines 18 as much as possible, especially in the higher field regions. For example, in the upper HTS-coils 12 shown in FIG. 6, the left three portions of the HTS-coils 12 are aligned and angled one way and the right three portions are aligned and angled the opposite way to help obtain this alignment.

Figure 6:
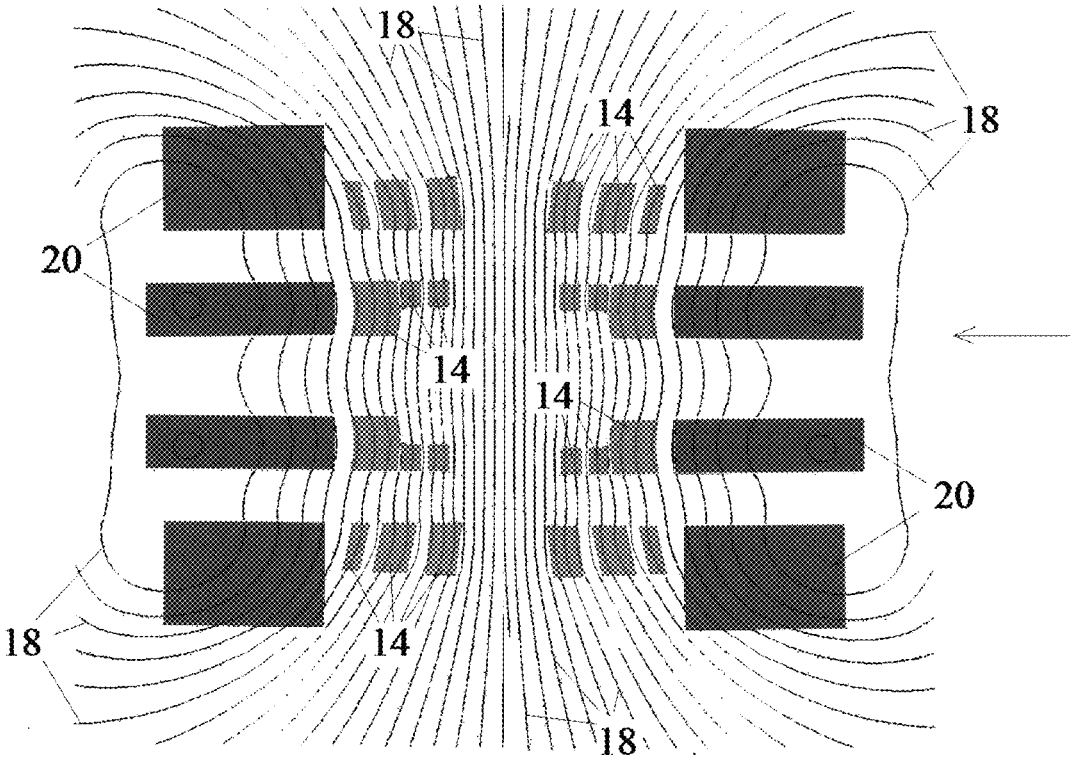
FIG. 6 is a depiction of a calculation of the magnetic fields in a dipole-magnet cross-section comprised of HTS-coils and LTS-coils.

In a coil design of a 20 T hybrid dipole for certain accelerators, lower-field blocks may be made with conventional Low Temperature Superconductors (LTS) to reduce cost, and the high-field blocks may be made with HTS, see FIG. 6. The magnetic design, as before, is aligned to reduce the field errors (and to reduce the amount of HTS conductor needed) by tilting the HTS-coils 12 to substantially align them with the magnetic-field-lines 18. The 12 mm ReBCO HTS-tape 2 typically carries several thousand amperes in such a geometry. A magnet made with two (or even four) conductors in parallel may carry over ten thousand amperes.

Preliminary Model Calculations with COMSOL

Figure 8A:
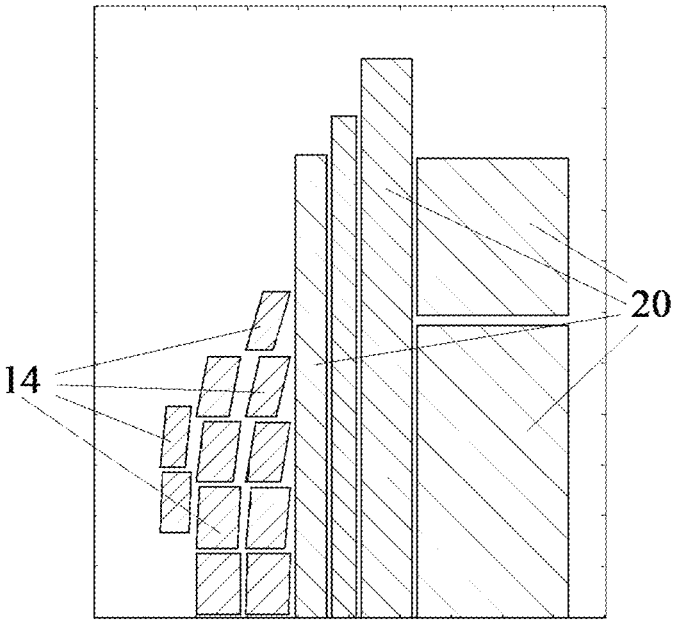
FIG. 8A is a depiction of HTS-coil cross sections and LTS-coil cross-sections for a second calculation of the magnetic fields in a quadrant of a dipole-magnet.
Figure 8B:
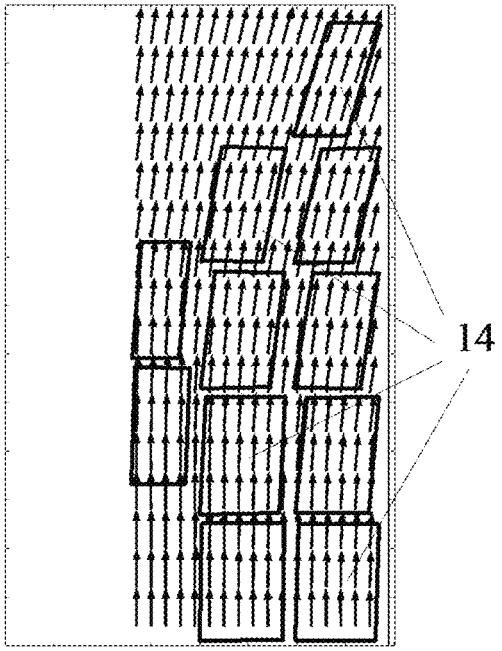
FIG. 8B shows the inner portion of FIG. 8A wherein arrows represent the direction of the magnetic-field-lines.

A preliminary finite-element-analysis using COMSOL's AC/DC Module (www.comsole.com) quantifies the reduction in field perturbation that might be expected from tape alignment. FIG. 8 shows another model (different than that of FIG. 5 and FIG. 6) with HTS-tape 2 tilted/angled within numerous blocks. The predicted field perturbations are proportional to the magnitude of the transverse field and can be reduced by an order of magnitude or more, depending on the degree of alignment.

Flat, Tilted Coils.

The tilting may be applied to make the HTS-tape-width 6 substantially parallel to the magnetic-field-lines 18, with various features as described above. By using placed, flat, rectangular tilted-HTS-coil-cross-sections 22 a substantial alignment with the magnetic-field-lines 18 can be achieved. This embodiment may be simple to manufacture. However curvature or divergence in the magnetic-field-lines 18 may lead to some remaining misalignment.

An Embodiment—Curving and Tilting the Coils

Figure 9:
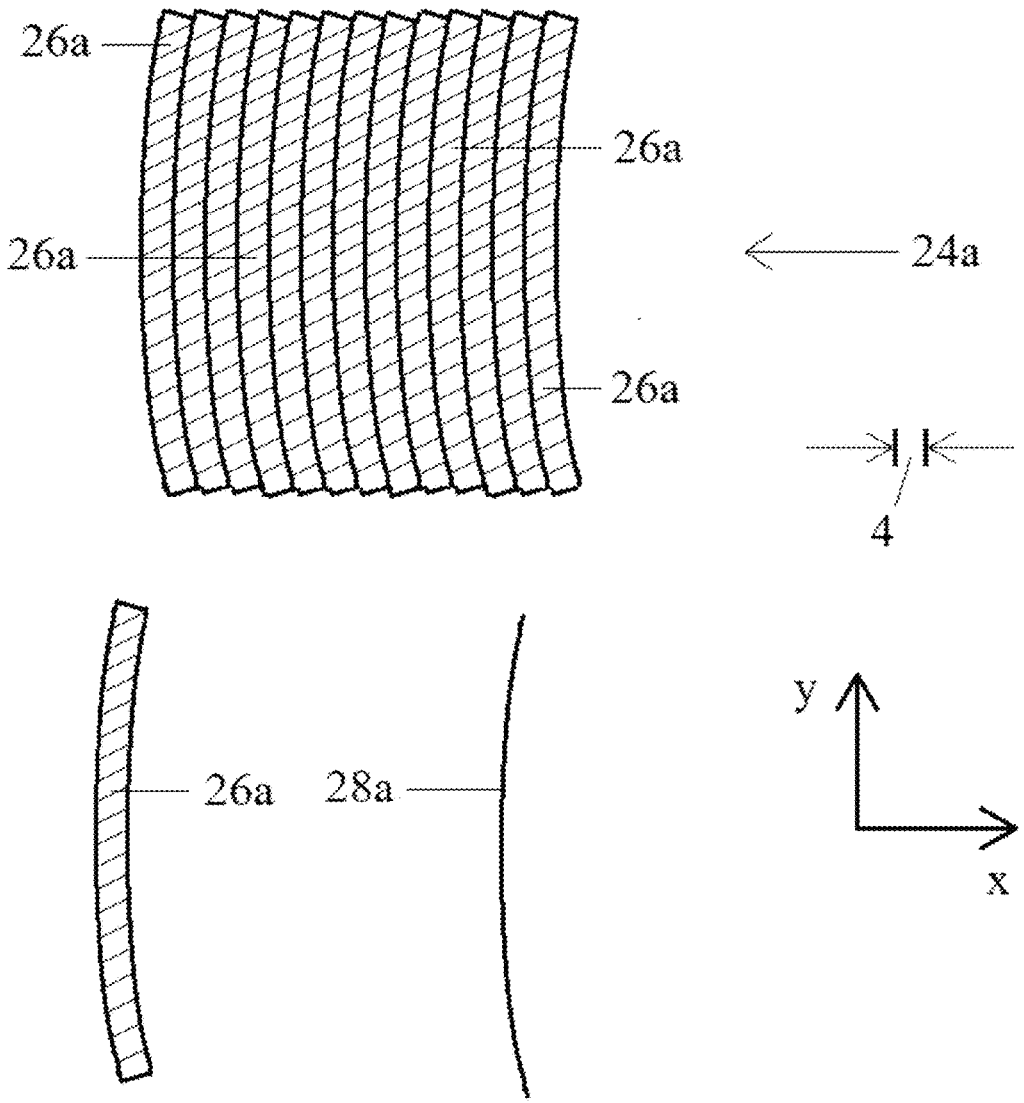
FIG. 9 is a first schematic view of a curved and untilted HTS-coil cross-section, a first schematic view of a curved and untilted HTS-tape cross-section, and a first schematic view of a curved-segment.
Figure 10:
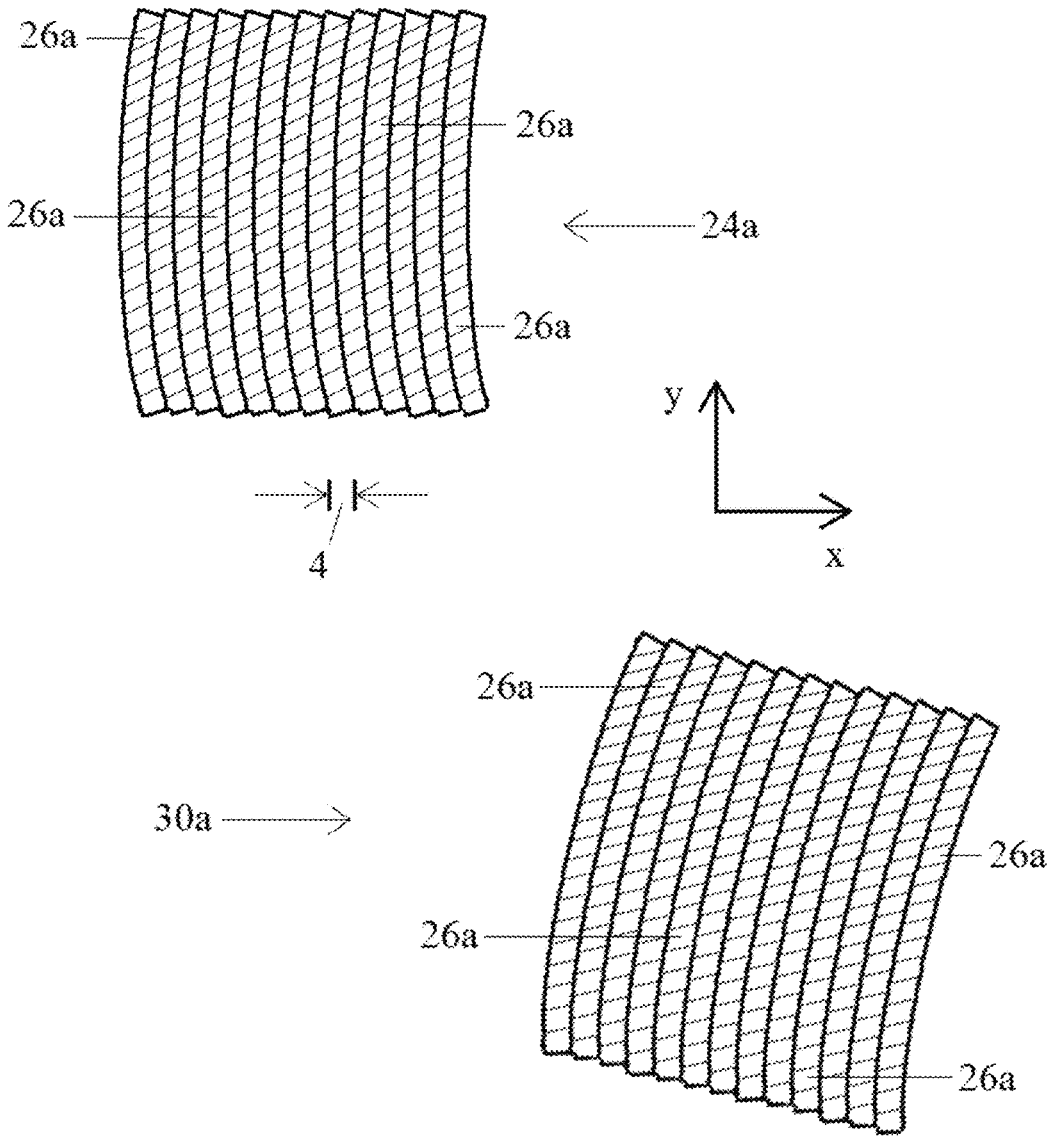
FIG. 10 is a first schematic view of a curved and untilted HTS-coil cross-section and a first schematic view of a curved and tilted HTS-coil cross-section.

An embodiment could involve curving and tilting the HTS-tape 2 to align the HTS-tape 2 large-dimension, which in this case is curved, with the magnetic-field-lines 18. FIG. 9 is a schematic of a curved-HTS-coil-cross-section 24*a* comprised of curved-HTS-tape 26*a* having a curved-cross-section. The curved-HTS-tape 26*a* has a cross section comprised of two curved-segments 28*a* that are separated by a very small HTS-tape-thickness 4. The curved-HTS-tape 26*a* is formed by simply using support structures which themselves have curved surfaces and pressing those support structures into the HTS-tape 2. HTS-tape 2 can bend to conform to such support structures. The top portion of FIG. 10 shows a schematic of a curved-HTS-coil-cross-section 24*a*, while the bottom portion of FIG. 10 shows a schematic of a curved-and-titled-HTS-tape-block-cross-section 30*a*.

Figure 11:
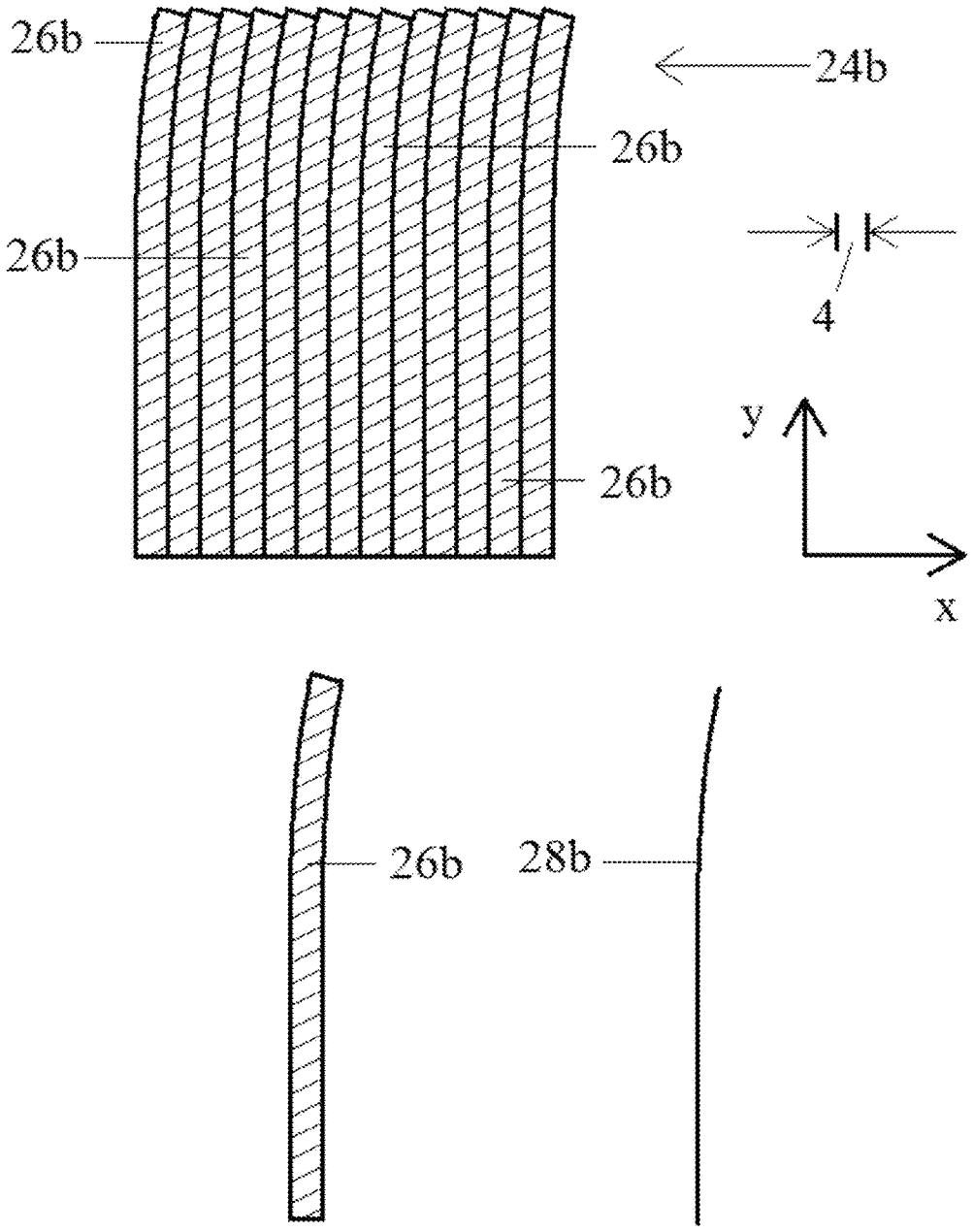
FIG. 11 is a second schematic view of a curved and untilted HTS-coil cross-section, a second schematic view of a curved and untilted HTS-tape cross-section, and a second schematic view of a curved-segment.
Figure 12:
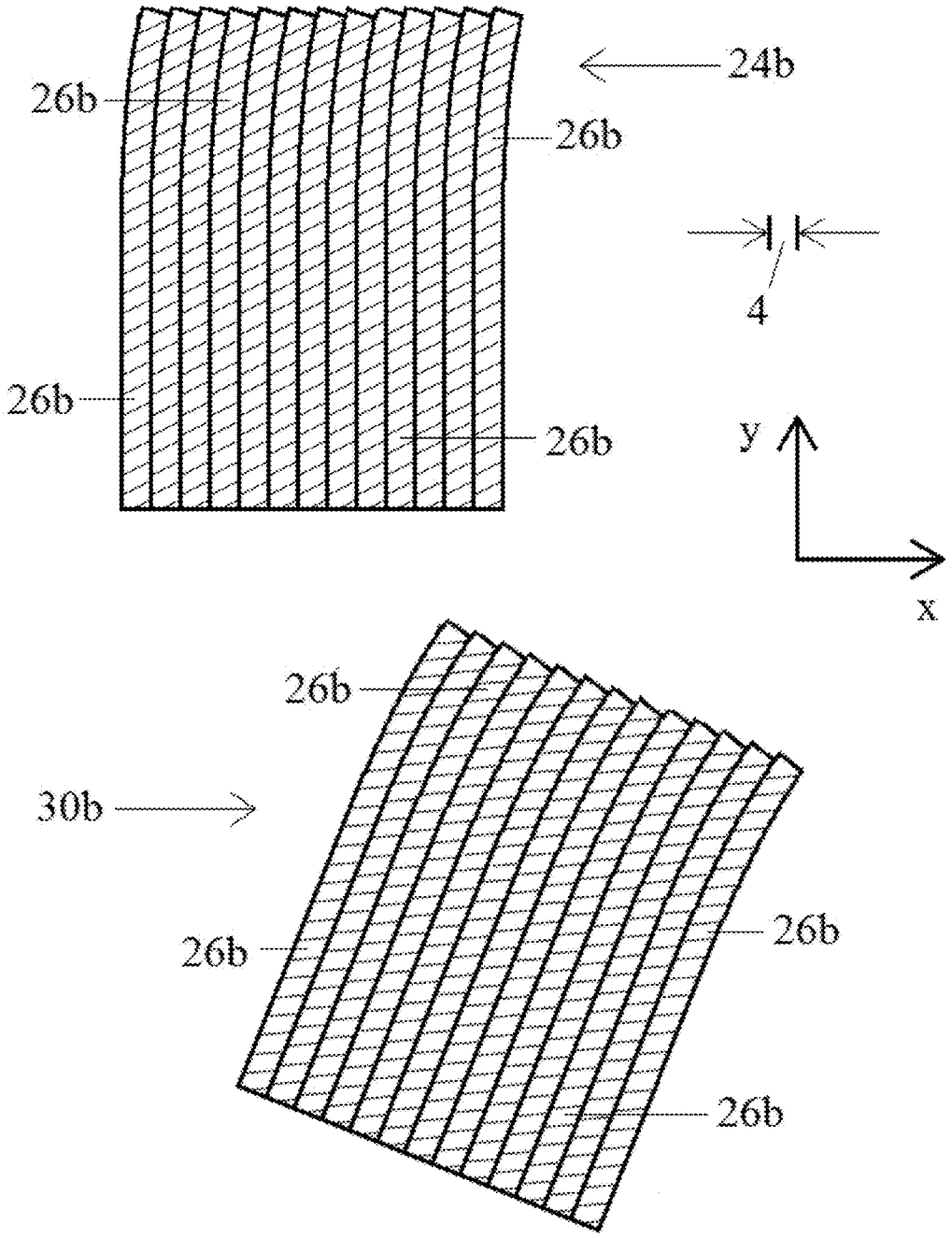
FIG. 12 is a second schematic view of a curved and untilted HTS-coil cross-section and a second schematic view of a curved and tilted HTS-coil cross-section.

The curving of the HTS-tape 2 need not be uniform or continuous, as the goal is to align the HTS-tape 2 large-dimension, which in this case is curved, with the magnetic-field-lines 18. FIG. 11 is a schematic of a curved-HTS-coil-cross-section 24*b* comprised of curved-HTS-tape 26*b* having a curved-cross-section. The curved-HTS-tape 26*b* has a cross section comprised of two curved-segments 28*b* that are separated by a very small HTS-tape-thickness 4. The curved-HTS-tape 26*b* is formed by simply using support structures which themselves have curved surfaces and pressing those support structures into the HTS-tape 2. HTS-tape 2 bends easily to conform to such support structures. The top portion of FIG. 12 shows a schematic of a curved-HTS-coil-cross-section 24*b*, while the bottom portion of FIG. 12 shows a schematic of a curved-and-titled-HTS-tape-block-cross-section 30*b*.

Curved, Tilted Coils.

The curving and tilting may be applied to make the HTS-tape-width 6 substantially parallel to the magnetic-field-lines 18, with various features as described above. By using a placed curved-and-titled-HTS-tape-block-cross-section 30 a substantial alignment with the magnetic-field-lines 18 can be achieved. This embodiment may allow alignment to curved magnetic-field-lines 18 while carefully forming the support structures to manufacture it. However, any divergence in the magnetic-field-lines 18 may lead to some remaining misalignment.

An Embodiment—Wedge Separation of Flat Windings and Tilting of the Coils

Figure 13:
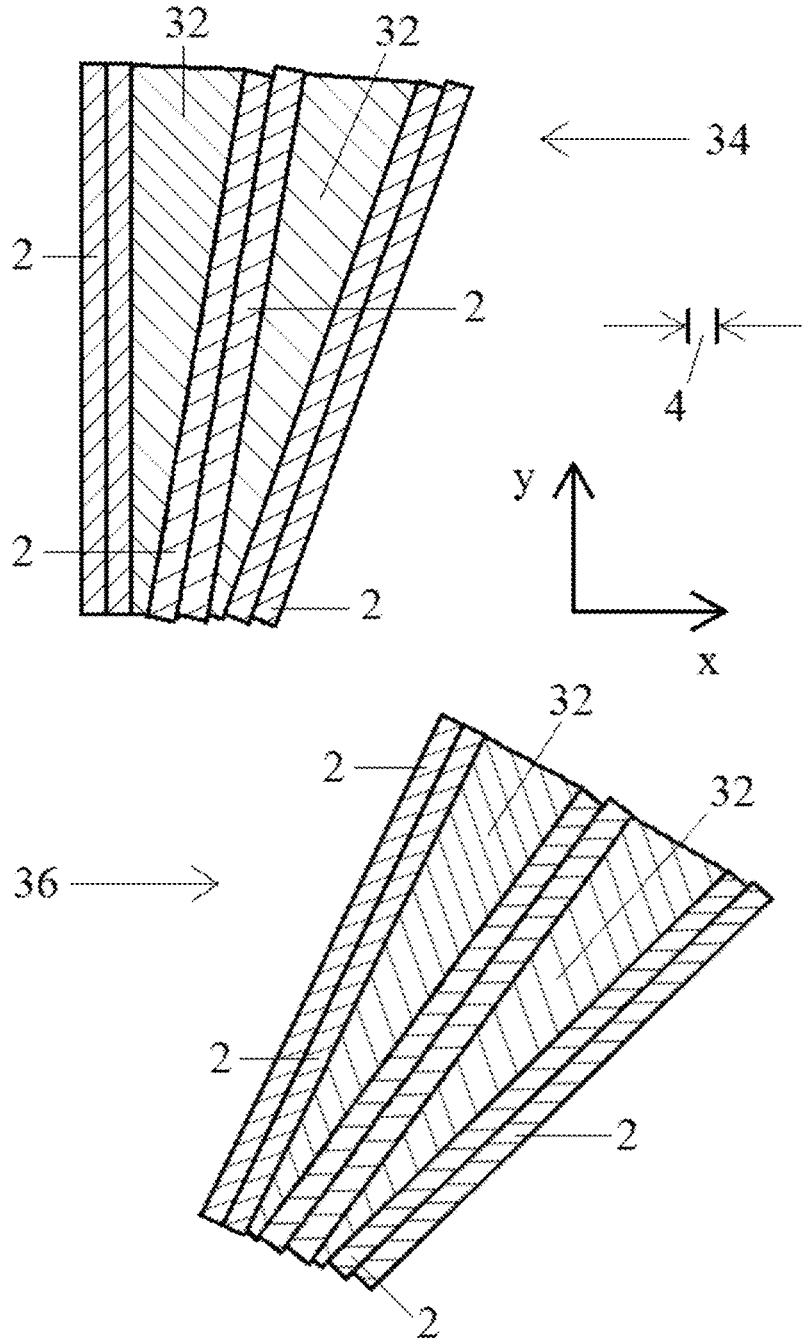
FIG. 13 is a schematic view of an untilted HTS-coil cross-section comprised of flat HTS-tape and nonconducting wedge-shaped-material as well as a schematic view of a tilted HTS-coil cross-section comprised of flat HTS-tape and nonconducting wedge-shaped-material.

An embodiment could involve placing nonconducting wedge-shaped-material 32 which may be triangular in shape within the HTS-coil 12 in order to tilt portions of the HTS-tape 2 with respect to other portions, and then further tilting the block to substantially align it with the magnetic-field-lines 18. FIG. 13 shows nonconducting wedge-shaped-material 32 that is placed between windings 10 within the HTS-coil 12 such that individual windings 10 are tilted differently from other windings 10 within the same HTS-coil 12. The top portion of FIG. 13 shows a schematic of a wedge-separated-HTS-tape-block-cross-section 34 while the bottom portion of FIG. 13 shows a tilted-wedge-separated-HTS-tape-block-cross-section 36.

Flat, Wedge-Separated, Tilted Coils.

Wedge-separation with nonconducting wedge-shaped-material 32 and tilting of the HTS-coil 12 may be applied to make the HTS-tape-width 6 substantially parallel to the magnetic-field-lines 18, with various features described above. By using a placed tilted-wedge-separated-HTS-tape-block-cross-section 36 a substantial alignment with the magnetic-field-lines 18 can be achieved. This embodiment may allow alignment to divergent magnetic-field-lines 18.

An Embodiment—Wedge Separation of Curved Windings and Tilting of the Coils

Figure 14:
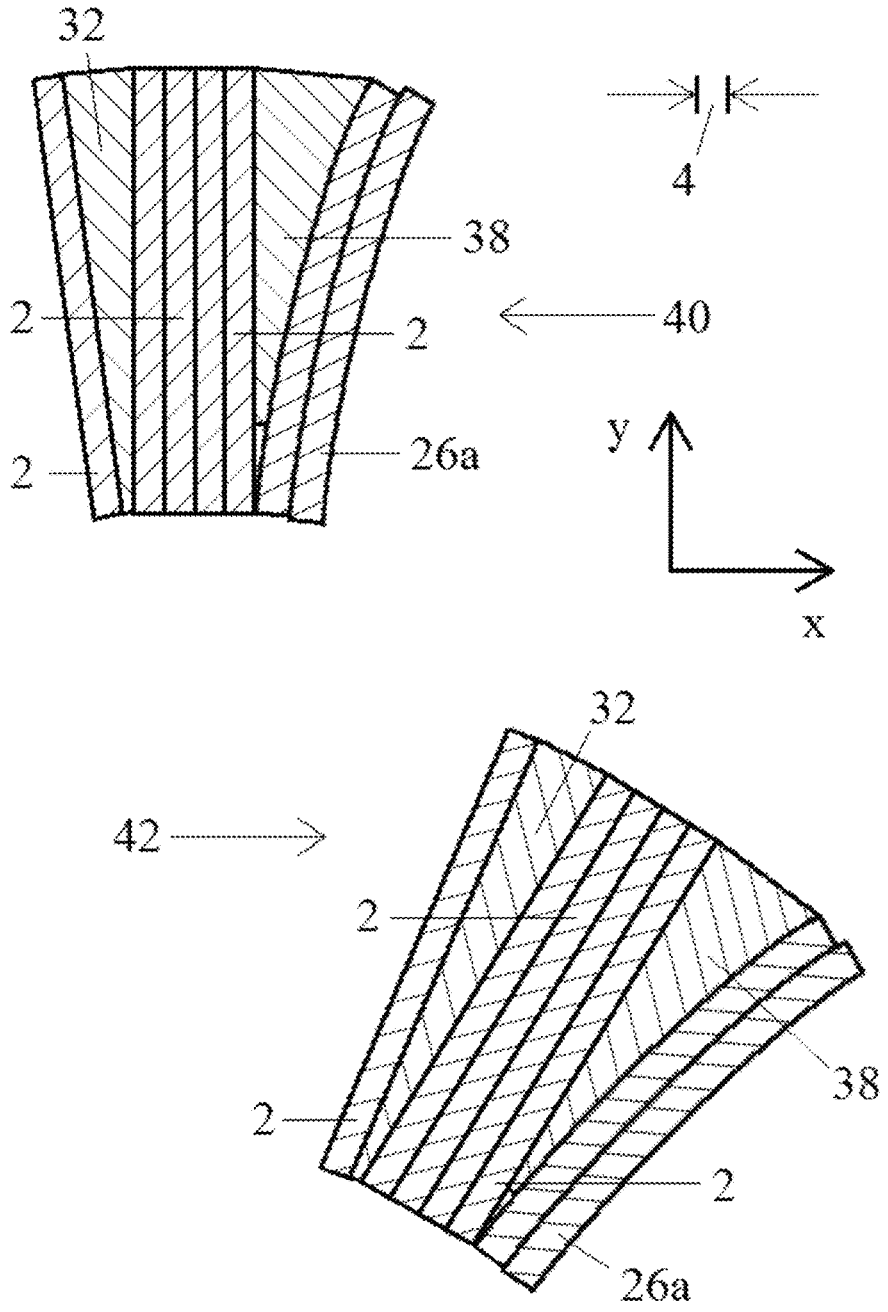
FIG. 14 is a schematic view of an untilted HTS-coil cross-section comprised of curved HTS-tape and nonconducting curved-and-wedge-shaped-material as well as a schematic view of a tilted HTS-coil cross-section comprised of curved HTS-tape and nonconducting curved-and-wedge-shaped-material.

An embodiment could involve forming the nonconducting curved-and-wedge-shaped-material 38 within the HTS-coil 12 in order to curve and tilt portions of the HTS-tape 2 with respect to other portions, and then further tilting the block to substantially align it with the magnetic-field-lines 18. FIG. 14 shows curved-and-wedge-shaped-material 38 that is placed between windings 10 within the HTS-coil 12 such that individual windings 10 are tilted differently from other windings 10 within the same HTS-coil 12. The top portion of FIG. 14 shows a schematic of a curved-and-wedge-separated-HTS-tape-block-cross-section 40, while the bottom portion of FIG. 14 shows a tilted-curved-and-wedge-separated-HTS-tape-block-cross-section 42. Note that in some cases the HTS-tape 2 may have an infinite radius of curvature (that is, flat HTS-tape 2 is a subset of curved HTS-tape 2 in this embodiment.)

Curved, Wedge-Separated, Tilted Coils.

Wedge-separation with nonconducting curved-and-wedge-shaped-material 38 and tilting of the HTS-coil 12 may be applied to make the HTS-tape-width 6 substantially parallel to the magnetic-field-lines 18, with various features as described above. By using a placed tilted-curved-and-wedge-separated-HTS-tape-block-cross-section 42 a substantial alignment with the magnetic-field-lines 18 can be achieved. This embodiment may allow alignment to curved and divergent magnetic-field-lines 18, making it a versatile embodiment and the one that can align the HTS-tape-width 6 to the magnetic-field-lines 18.

Figure 15:
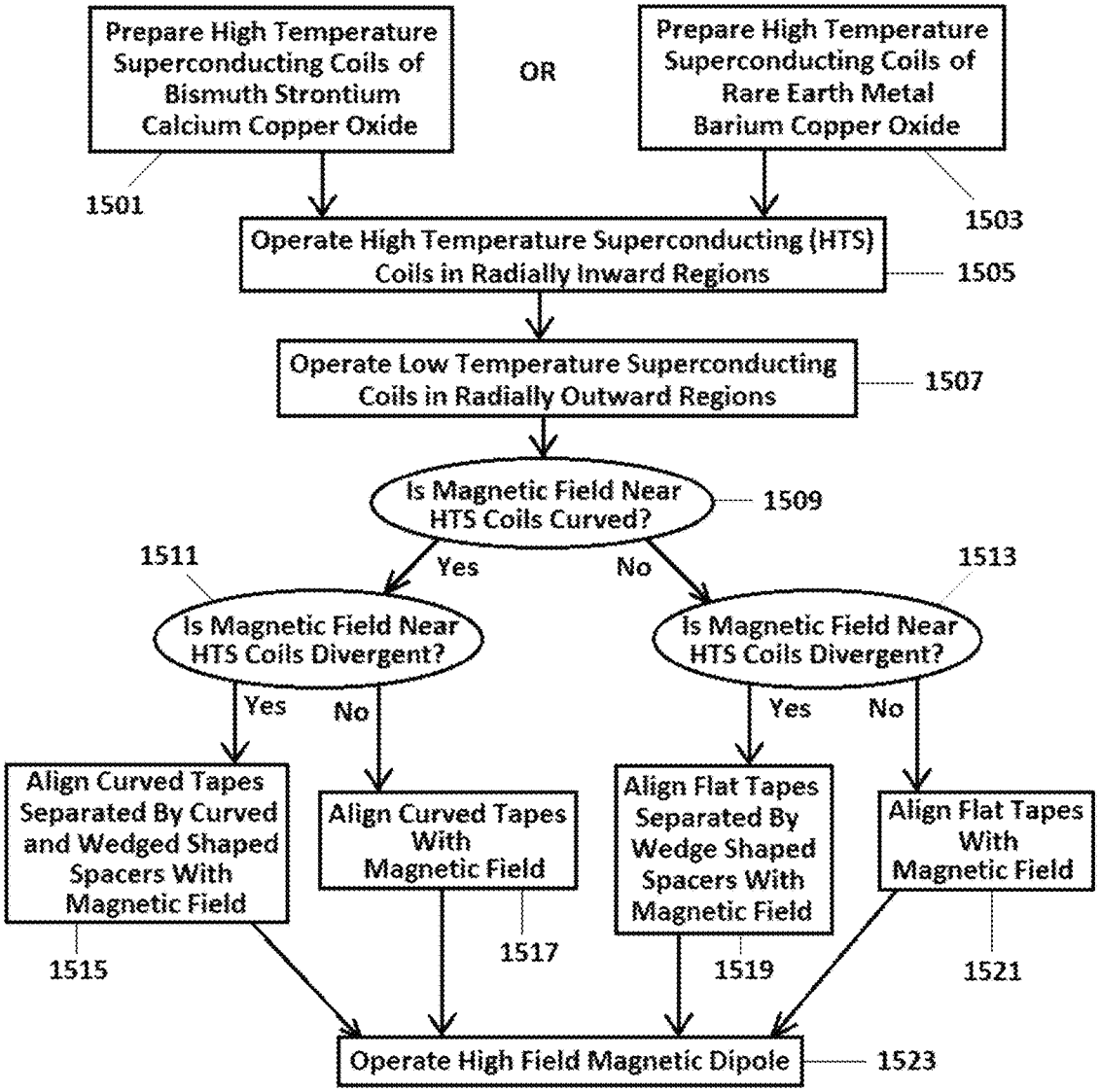
FIG. 15 illustrates a flowchart diagram of the present invention.

FIG. 15 illustrates a flowchart of the present invention. In step 1501, high temperature superconducting coils of bismuth strontium calcium copper oxide are prepared, and in step 1503, high temperature superconducting coils of rare earth metal barium copper oxide are prepared. In step 1505 the high temperature superconducting (HTS) coils are operated in the radially inward regions, and in step 1507, the low temperature superconducting coils in the radial outward regions are operated. In step 1509, it is determined if the magnetic field near the HTS coils are curved. If the result in step 1509 is yes, in step 1511, it is determined if the magnetic field near the HTS coils is divergent. If the result in step 1509 is no, in step 1513, it is determined if the magnetic field near the HTS coils is divergent.

If the result, in step 1511 is yes, in step 1515 the curved tapes separated by curved and wedge shaped spacers are aligned with the magnetic field, and if the result in step 1511 is no, in step 1517 the curved tapes are aligned (without the spacers) with the magnetic field.

If the result in step 1513 is yes, in step 1519, the flat tapes separated by wedge shaped spacers are aligned with the magnetic field, and if the result, in step 1513 is no, in step 1521 the flat tapes are aligned (without the spacers) with the magnetic field.

Next, in step 1523 the High field magnetic dipole is operated

The foregoing summary is illustrative only and is not intended to be in any way limiting. In addition to the illustrative aspects, embodiments, and features described above, further aspects, embodiments, and features will become apparent by reference to the drawings and the above detailed description.

It will be understood that any geometric shape, which is expressly or implicitly disclosed in the specification and/or recited in a claim is intended for illustration only and is not intended to be in any way limiting. For example, the term wedge is intended to include shapes that approximate wedges and/or trapezoids.

It will be understood that any compound, material or substance which is expressly or implicitly disclosed in the specification and/or recited in a claim as belonging to a group or structurally, compositionally and/or functionally related compounds, materials or substances, includes individual representatives of the group and all combinations thereof.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A high-magnetic-field dipole-magnet system comprising:

a plurality of high-temperature-superconducting-coils comprised of windings of high-temperature-superconducting-tape with the width of said high-temperature-superconducting-tape substantially aligned with said high-magnetic-field;

a plurality of low-temperature-superconducting-coils comprised of windings of low-temperature-superconducting-wire;

a cooling system to cool said high-temperature-superconducting-coils and to cool said low-temperature-superconducting-coils;

a first plurality of support-structures located proximate to said high-temperature-superconducting-coils to support said high-temperature-superconducting-coils;

a second plurality of support-structures located proximate to said low-temperature-superconducting-coils to support said low-temperature-superconducting-coils;

a first plurality of electrical-contacts located at the ends of said high-temperature-superconducting-coils to allow electric-current into and out of said high-temperature-superconducting-coils;

a second plurality of electrical-contacts located at the ends of said low-temperature-superconducting-coils to allow electric-current into and out of said low-temperature-superconducting-coils; and an open-region located in the radially-central-region of said dipole-magnet system.

2. The system in accordance with claim 1, wherein said high-temperature-superconducting-coils are located in radially-inward-regions of said dipole-magnet.

3. The system in accordance with claim 1, wherein said low-temperature-superconducting-coils are located in radially-outward-regions of said dipole-magnet.

4. The system in accordance with claim 1, wherein said high-temperature-superconducting-coils are comprised of bismuth-strontium-calcium-copper-oxide.

5. The system in accordance with claim 1, wherein said high-temperature-superconducting-coils are comprised of rare-earth-metal, barium-copper-oxide (ReBCO) compounds, wherein said rare-earth-metal is yttrium, samarium, neodymium, or gadolinium or combinations thereof.

6. The system in accordance with claim 1, wherein said high-temperature-superconducting-tape has a rectangular-cross-section positioned and aligned so that a large-dimension of said rectangular-cross-section is substantially parallel to said high-magnetic-field.

7. The system in accordance with claim 1, wherein said high-temperature-superconducting-tape has a curved-cross-section comprised of curved-segments separated by a distance positioned and aligned so that said curved-segments of said curved-cross-section are substantially parallel to said high-magnetic-field.

8. The system in accordance with claim 1, wherein said high-temperature-superconducting-coils are comprised of windings of said high-temperature-superconducting-tape that have a rectangular-cross-section and are positioned and aligned by a nonconducting wedge-shaped-material between said windings of said high-temperature-superconducting-coils so that a large-dimension of said rectangular-cross-section is substantially parallel to said high-magnetic-field.

9. The system in accordance with claim 1, wherein said high-temperature-superconducting-coils are comprised of windings of said high-temperature-superconducting-tape that have a combination of a rectangular-cross-section and a curved-cross-section, and are positioned and aligned by a nonconducting curved-and-wedge-shaped-material between said windings of said high-temperature-superconducting-coils so that a large-dimension of said rectangular-cross-section and said curved-cross-section is substantially parallel to said high-magnetic-field.

10. A method of producing high-magnetic-fields in a dipole-magnet comprising the steps of:

operating a plurality of high-temperature-superconducting-coils comprised of windings of high-temperature-superconducting-tape with a width of said high-temperature-superconducting-tape substantially aligned with said high-magnetic-field;

operating a plurality of low-temperature-superconducting-coils comprised of windings of low-temperature-superconducting-wire;

operating a cooling system to cool said high-temperature-superconducting-coils and to cool said low-temperature-superconducting-coils;

operating a first plurality of support-structures located proximate to said high-temperature-superconducting-coils to support said high-temperature-superconducting-coils against large Lorentz-forces present in said dipole-magnet;

operating a second plurality of support-structures located proximate to said low-temperature-superconducting-coils to support said low-temperature-superconducting-coils against large Lorentz-forces present in said dipole-magnet;

operating a first plurality of electrical-contacts located at ends of said high-temperature-superconducting-coils to allow electric-current into and out of said high-temperature-superconducting-coils;

operating a second plurality of electrical-contacts located at ends of said low-temperature-superconducting-coils to allow electric-current into and out of said low-temperature-superconducting-coils;

operating an open-region located in a radially-central-region of said dipole-magnet.

11. The method in accordance with claim 10, wherein said high-temperature-superconducting-coils are located in radially-inward-regions of said dipole-magnet.

12. The method in accordance with claim 10, wherein said low-temperature-superconducting-coils are located in radially-outward-regions of said dipole-magnet.

13. The method in accordance with claim 10, wherein said high-temperature-superconducting-coils are comprised of bismuth-strontium-calcium-copper-oxide.

14. The method in accordance with claim 10, wherein said high-temperature-superconducting-coils are comprised of rare-earth-metal, barium-copper-oxide (ReBCO) compounds, wherein said rare-earth-metal is yttrium, samarium, neodymium, or gadolinium or combinations thereof.

15. The method in accordance with claim 10, wherein said high-temperature-superconducting-tape has a rectangular-cross-section positioned and aligned so that a large-dimension of said rectangular-cross-section is substantially parallel to said high-magnetic-field.

16. The method in accordance with claim 10, wherein said high-temperature-superconducting-tape has a curved-cross-section comprised of curved-segments separated by a distance positioned and aligned so that said curved-segments of said curved-cross-section are substantially parallel to said high-magnetic-field.

17. The method in accordance with claim 10, wherein said high-temperature-superconducting-coils are comprised of windings of said high-temperature-superconducting-tape that have a rectangular-cross-section and are positioned and aligned by nonconducting wedge-shaped-material between said windings of said high-temperature-superconducting-coils so that a large-dimension of said rectangular-cross-section is substantially parallel to said high-magnetic-field.

18. The method in accordance with claim 10, wherein said high-temperature-superconducting-coils are comprised of windings of said high-temperature-superconducting-tape that have a combination of a rectangular-cross-section and a curved-cross-section, and are positioned and aligned by nonconducting curved-and-wedge-shaped-material between said windings of said high-temperature-superconducting-coils so that a large-dimension of said rectangular-cross-section and said curved-cross-section is substantially parallel to said high-magnetic-field.

* * * * *